US007525564B2

(12) United States Patent
Okamoto et al.

(10) Patent No.: US 7,525,564 B2
(45) Date of Patent: Apr. 28, 2009

(54) IMAGE PRINTING APPARATUS

(75) Inventors: Akira Okamoto, Tokyo (JP); Kazumichi Yamauchi, Tokyo (JP); Kazutoshi Yoshimura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 217 days.

(21) Appl. No.: 11/362,009

(22) Filed: Feb. 27, 2006

(65) Prior Publication Data

US 2006/0269339 A1 Nov. 30, 2006

(30) Foreign Application Priority Data

May 27, 2005 (JP) ..... 2005-155008

(51) Int. Cl.
*G03G 15/00* (2006.01)

(52) U.S. Cl. ..... 347/262; 399/396

(58) Field of Classification Search ..... 347/262; 399/381, 396–397, 400–401, 405
See application file for complete search history.

(56) References Cited

U.S. PATENT DOCUMENTS 6,311,039 B1 * 10/2001 Funamizu et al. ..... 399/394
2003/0143004 A1 * 7/2003 Shimazu ..... 399/396
2004/0213610 A1 * 10/2004 Yuasa ..... 399/401
2005/0254870 A1 * 11/2005 Takahashi ..... 399/388

FOREIGN PATENT DOCUMENTS

JP 03288166 A * 12/1991
JP 2001-341898 12/2001

* cited by examiner

*Primary Examiner*—Huan H Tran
(74) *Attorney, Agent, or Firm*—Finnegan, Henderson, Farabow, Garrett & Dunner, L.L.P.

(57) ABSTRACT

An image printing apparatus, which can correct variation in inter-sheet distance at the time of conveyance of transfer sheets, comprising an image printing section which performs image printing by sequentially conveying a plurality of transfer sheets at predetermined intervals at a first convey velocity and performing transfer and fixing of a toner image on each transfer sheet, a timepiece section which measures a time required for the image printing section to perform image printing on the each transfer sheet, and a delivery convey section which receives each transfer sheet on which image printing is performed by the image printing section and delivers the each transfer sheets while adjusting intervals therebetween by conveying the each transfer sheets upon changing the convey velocity to a second convey velocity set on the basis of the measured time required for the image printing on the each transfer sheet.

20 Claims, 7 Drawing Sheets

IMAGE PRINTING APPARATUS

CROSS-REFERENCE TO RELATED APPLICATION

This application makes reference to, incorporation the same herein, and claims all benefits accruing under 35 U.S.C. § 119 from an application for Image Printing Apparatus earlier filed in the Japanese Patent Office on May 27, 2005, and there duly assigned No. 2005-155008.

BACKGROUND OF THE INVENTION

1. Field of the Invention

The present invention relates to an image printing apparatus and, more particularly, to a technique of printing an image in an image printing apparatus by transferring a toner image formed on a photosensitive drum onto a transfer sheet and thermally fixing the image.

2. Description of Related Art

Electrophotographic image printing apparatuses have been conventionally used for copying machines, printers, and the like. In an electrophotographic image printing apparatus, first of all, while a uniformly charged photosensitive drum as an image carrying body is moved (rotated), its surface is exposed to a laser beam to form an electrostatic latent image on the photosensitive drum, and the formed electrostatic latent image is developed to form a toner image on the photosensitive drum. A transfer separation portion then transfers the formed toner image onto a transfer sheet and separates the transfer sheet from the photosensitive drum. The transfer sheet onto which the toner image is transferred is sandwiched and conveyed by the heat roller and pressure roller of a fixing section, and the image is fixed with heat and pressure, thereby performing image printing operation.

In such an image printing apparatus, toner is not fixed in the interval between the transfer separation portion and the fixing section. If, therefore, a transfer sheet is sandwiched and conveyed by the roller pair, the toner image on the transfer sheet is disturbed, and the roller pair is stained. For this reason, the transfer sheet is conveyed while being placed on, for example, a conveyor belt. The transfer sheet cannot therefore be conveyed accurately as compared with the case wherein the roller pair is used. In addition, when a transfer sheet enters between the heat roller and pressure roller of the fixing section, the sheet may strike one of the roller surfaces and slip to cause a delay in conveyance. Owing to such problems in conveyance, if the interval between transfer sheets which are continuously conveyed (i.e., the interval between the trailing edge of a transfer sheet which is transmitted first and the leading edge of a transfer sheet which is conveyed next; to be referred to as an inter-sheet distance hereafter) is not sufficient, the transfer sheets may overlap. It therefore cannot help but ensure a sufficient inter-sheet distance between transfer sheets. Ensuring a sufficient inter-sheet distance will decrease the image printing efficiency.

In an image printing apparatus including a transfer sheet reversing section which reverses the convey direction of a transfer sheet and reverses the obverse and reverse surfaces of the transfer sheet so as to perform reverse delivery and duplex image printing, it is necessary to ensure a large inter-sheet distance to prevent the next transfer sheet from entering the transfer sheet reversing section during sheet reversing operation. Since the image printing efficiency decreases as the inter-sheet distance increases, some apparatus is designed to prevent a decrease in image printing efficiency by increasing the convey velocity of transfer sheets. Even this technique cannot prevent the above trouble in conveyance. In addition, since slip may occur between, for example, convey rollers and a transfer sheet when the convey direction is reversed, if a sufficient inter-sheet distance cannot be ensured between transfer sheets to be continuously conveyed, the transfer sheets may collide with each other. It is therefore necessary to ensure a sufficient inter-sheet distance in consideration of these troubles. This leads to a decrease in image printing efficiency.

In order to improve the image printing efficiency, the image printing speed may be increased. An increase in image printing speed is limited by deterioration in image quality, sticking of a transfer sheet to the photosensitive drum, and a restriction on the rotational speed of a polygon motor used for laser beam scanning. Under the circumstances, an improvement in image printing efficiency may be achieved by minimizing the inter-sheet distance. For example, there is provided an image printing apparatus which determines whether the distance to a preceding transfer sheet is a predetermined distance or more, and ensures a sufficient inter-sheet distance by temporarily decreasing the convey velocity of the transfer sheet if the distance is less than the predetermined distance (see Japanese Unexamined Patent Publication No. 2001-341898 (patent reference 1)). However, the image printing apparatus disclosed in patent reference 1 is designed to correct the problem of an inter-sheet distance shortage which occurs at the time of feed operation, but is not designed to correct variations in inter-sheet distance due to problems in the above image printing process and problems in conveyance at the time of sheet reversing operation. If, for example, the convey velocity is changed during the printing process to ensure a sufficient inter-sheet distance, a deterioration in image quality occurs.

Recently, many post-processing apparatuses for electrophotographic image printing apparatuses have been contrived to perform bookbinding post-processing for delivered transfer sheets, e.g., collation, stapling, and center folding/saddle stitching. As the above variations in inter-sheet distance occur, the timing of the delivery of transfer sheets, i.e., the timing at which the post-processing apparatus receives a transfer sheet, varies. In some cases, mechanical operation in the post-processing apparatus cannot cope with large variations in the timing of the delivery of transfer sheets.

Demands therefore have arisen for a technique of correcting variations in inter-sheet distance during conveyance, improving image printing efficiency by minimizing the inter-sheet distance, and stabilizing the timing of delivery to allow a post-processing apparatus to cope with such variations.

SUMMARY OF THE INVENTION

The present invention has been made in consideration of the above situation, and can provide an image printing apparatus which can correct variations in inter-sheet distance at the time of conveyance of transfer sheets.

According to a first aspect of the present invention, there is provided an image printing apparatus comprising:

an image printing section which performs image printing by conveying a transfer sheet at a first convey velocity and performing transfer and fixing of a toner image on the transfer sheet;

a timepiece section which measures a time required for the image printing section to perform image printing; and a delivery convey section which receives the transfer sheet on which image printing is performed by the image printing section and conveys and delivers the transfer sheet upon changing the convey velocity to a second convey velocity on the basis of the measured time required for the image printing.

According to a second aspect of the present invention, there is provided an image printing apparatus comprising:

an image printing section which performs image printing by sequentially conveying a plurality of transfer sheets at predetermined intervals at a first convey velocity and performing transfer and fixing of a toner image on each transfer sheet;

a timepiece section which measures a time required for the image printing section to perform image printing on the each transfer sheet; and a delivery convey section which receives each transfer sheet on which image printing is performed by the image printing section and delivers the each transfer sheets while adjusting intervals therebetween by conveying the each transfer sheets upon changing the convey velocity to a second convey velocity set on the basis of the measured time required for the image printing on the each transfer sheet.

According to a third aspect of the present invention, there is provided an apparatus as set forth in the above first and second aspects, further comprising a first detection portion which is provided near a position where the transfer is performed, and detects the transfer sheet, and a second detection portion which is provided near a position where the fixing is performed, and detects the transfer sheet, wherein the timepiece section measures a time required for the image printing on the basis of detection results obtained by the first detection portion and the second detection portion.

According to a fourth aspect of the present invention, there is provided an image printing apparatus comprising:

an image printing section which performs image printing by conveying a transfer sheet at a first convey velocity and performing transfer and fixing of a toner image on the transfer sheet;

a first timepiece section which measures a time required for the image printing section to perform image printing;

a reverse convey section which receives a transfer sheet on which image printing is performed by the image printing section, conveys the transfer sheet upon changing a velocity by accelerating the velocity at a timing set on the basis of the time measured by the first timepiece section and required for the image printing, and reverses an obverse surface and reverse surface of the transfer sheet while reversing a convey direction of the transfer sheet;

a second timepiece section which measures a time required for the reverse convey section to perform conveyance including reversing; and a delivery convey section which receives the transfer sheet reversed by the reverse convey section and conveys and delivers the transfer sheet upon changing the convey velocity to the second convey velocity set on the basis of the time measured by the second timepiece section and required for conveyance including the reversing.

According to a fifth aspect of the present invention, there is provided n image printing apparatus comprising:

an image printing section which performs image printing by sequentially conveying a plurality of transfer sheets at predetermined intervals at a first convey velocity and performing transfer and fixing of a toner image on each transfer sheet;

a first timepiece section which measures a time required for the image printing section to perform image printing on the each transfer sheet;

a reverse convey section which receives the each transfer sheet on which image printing is performed by the image printing section, conveys the each transfer sheet upon changing the convey velocity by acceleration at a timing set on the basis of the time measured by the first timepiece section and required for the image printing on the each transfer sheet, and reverses the obverse surface and reverse surface of the each transfer sheet while reversing a convey direction of the each transfer sheet;

a second timepiece section which measures a time required for the reverse convey section to perform conveyance including reversing; and a, delivery convey section which receives the each transfer sheet reversed by the reverse convey section and conveys and delivers the each transfer sheet upon changing the convey velocity to the second convey velocity set on the basis of the time measured by the second timepiece section and required for conveyance including the reversing, wherein the transfer sheets are delivered while intervals between the transfer sheets are adjusted by the reverse convey section and the delivery convey section.

According to a sixth aspect of the present invention, there is provided an apparatus as set forth in the above fourth and fifth aspects, further comprising a first detection portion which is provided near a position where the transfer is performed, and detects the transfer sheet, a second detection portion which is provided near a position where the fixing is performed, and detects the transfer sheet, and a third detection portion which is provided near a position where the reversing is performed, and detects the transfer sheet, wherein the first timepiece section measures a time required for the image printing on the basis of detection results obtained by the first detection portion and the second detection portion, and the second timepiece section measures a time required for conveyance including the reversing on the basis of detection results obtained by the second timepiece section and the third detection portion.

According to a seventh aspect of the present invention, there is provided an image printing apparatus comprising:

an image printing section which performs image printing by conveying a transfer sheet at a first convey velocity and performing transfer and fixing of a toner image on the transfer sheet;

a first timepiece section which measures a time required for the image printing section to perform image printing;

a reverse convey section which receives a transfer sheet having an obverse surface on which image printing is performed by the image printing section, conveys the transfer sheet upon changing the convey velocity by acceleration at a timing set on the basis of a time measured by the first timepiece section and required for image printing on the obverse surface of the transfer sheet, and reverses obverse and reverse surfaces of the transfer sheet while reversing a convey direction of the transfer sheet;

a second timepiece section which measures a time required for the reverse convey section to perform conveyance including reversing;

a re-feed section which receives the transfer sheet reversed by the reverse convey section, conveys the transfer sheet upon changing the convey velocity by deceleration at a timing set on the basis of a time measured by the second timepiece section and required for conveyance including the reversing, and feeds the transfer sheet again to the image printing section; and a delivery convey section which receives the transfer sheet having a reverse surface on which image printing is performed by the image printing section, and conveys and delivers the transfer sheet upon changing the convey velocity to a second convey velocity set on the basis of a time measured by the first timepiece section and required for image printing on the reverse surface of the transfer sheet.

According to a eighth aspect of the present invention, there is provided an image printing apparatus comprising:

an image printing section which performs image printing by sequentially conveying a plurality of transfer sheets at predetermined intervals at a first convey velocity and performing transfer and fixing of a toner image on each transfer sheet;

a first timepiece section which measures a time required for the image printing section to perform image printing on the each transfer sheet;

a reverse convey section which receives the each transfer sheet having an obverse surface on which image printing is performed by the image printing section, conveys the each transfer sheet upon changing the convey velocity by acceleration at a timing set on the basis of a time measured by the first timepiece section and required for image printing on the observe surface of the each transfer sheet, and reverses the obverse surface and reverse surface of the each transfer sheet while reversing a convey direction of the each transfer sheet;

a second timepiece section which measures a time required for the reverse convey section to perform conveyance including reversing of the each transfer sheet;

a re-feed section which receives the each transfer sheet reversed by the reverse convey section, conveys the each transfer sheet upon changing the convey velocity by deceleration at a timing set on the basis of a time measured by the second timepiece section and required for conveyance including the reversing of the each transfer sheet, and feeds the each transfer sheet again to the image printing section; and a delivery convey section which receives the each transfer sheet having a reverse surface on which image printing is performed by the image printing section, and conveys and delivers the each transfer sheet upon changing the convey velocity to a second convey velocity set on the basis of a time measured by the first timepiece section and required for image printing on the reverse surface of the each transfer sheet, wherein the transfer sheets are delivered while intervals between the transfer sheets are adjusted by the reverse convey section, the re-feed section, and the delivery convey section.

According to a ninth aspect of the present invention, there is provided an apparatus as set forth in the above seventh and eighth aspects, further comprising a first detection portion which is provided near a position where the transfer is performed, and detects the transfer sheet, a second detection portion which is provided near a position where the fixing is performed, and detects the transfer sheet, and a third detection portion which is provided near a position where the reversing is performed, and detects the transfer sheet, wherein the first measuring portion measures a time required for image printing on the observe surface and the reverse surface on the basis of detection results obtained by the first detection portion and the second detection portion, and the second timepiece section measures a time required for conveyance including the reversing on the basis of at least a detection result obtained by the third detection portion.

According to a tenth aspect of the present invention, there is provided an apparatus as set forth in the above seventh to ninth aspects, wherein the fourth convey velocity is equal to the first convey velocity.

According to a eleventh aspect of the present invention, there is provided an apparatus as set forth in the above first to tenth aspects, further comprising a post-processing apparatus which receives the delivered transfer sheet and performs post-processing, and a notifying unit which notifies the post-processing apparatus of a state of the transfer sheet when the velocity is changed to the second convey velocity.

According to the image printing apparatuses in the first and second aspects, an inter-sheet distance at the time of conveyance in image printing operation can be corrected by delivering transfer sheets at a convey velocity set on the basis of the time required for image printing.

According to the image printing apparatuses in the fourth and fifth aspects, an inter-sheet distance at the time of conveyance in reverse delivery operation can be corrected by performing acceleration at the timing set on the basis of the time required for image printing and delivering transfer sheets at a convey velocity set on the basis of the time required for conveyance including reversing.

According to the image printing apparatuses in the seventh and eight aspects, an inter-sheet distance at the time of conveyance can be corrected by performing acceleration at the timing set on the basis of the time required for image printing on the observe surface of a transfer sheet, deceleration at the timing set on the basis of the time required for conveyance including reversing, and delivering transfer sheets at a convey velocity set on the basis of the time required for image printing on the obverse surface of a transfer sheet. This makes it possible to correct an inter-sheet distance at the time of conveyance in duplex image printing.

The present invention is more specifically described in the following paragraphs by reference to the drawings attached only by way of example.

BRIEF DESCRIPTION OF THE DRAWINGS

A more complete appreciation of the present invention, and many of the attendants advantages thereof, will become ready apparent as the same becomes better understood by reference to the following detailed description when considered in conjunction with the accompanying drawings in which like reference symbols and reference numerals indicate the same or similar components, wherein.

DETAILED DESCRIPTION OF THE PREFERRED EMBODIMENT

Arrangement of Image Printing Apparatus

Figure 1:
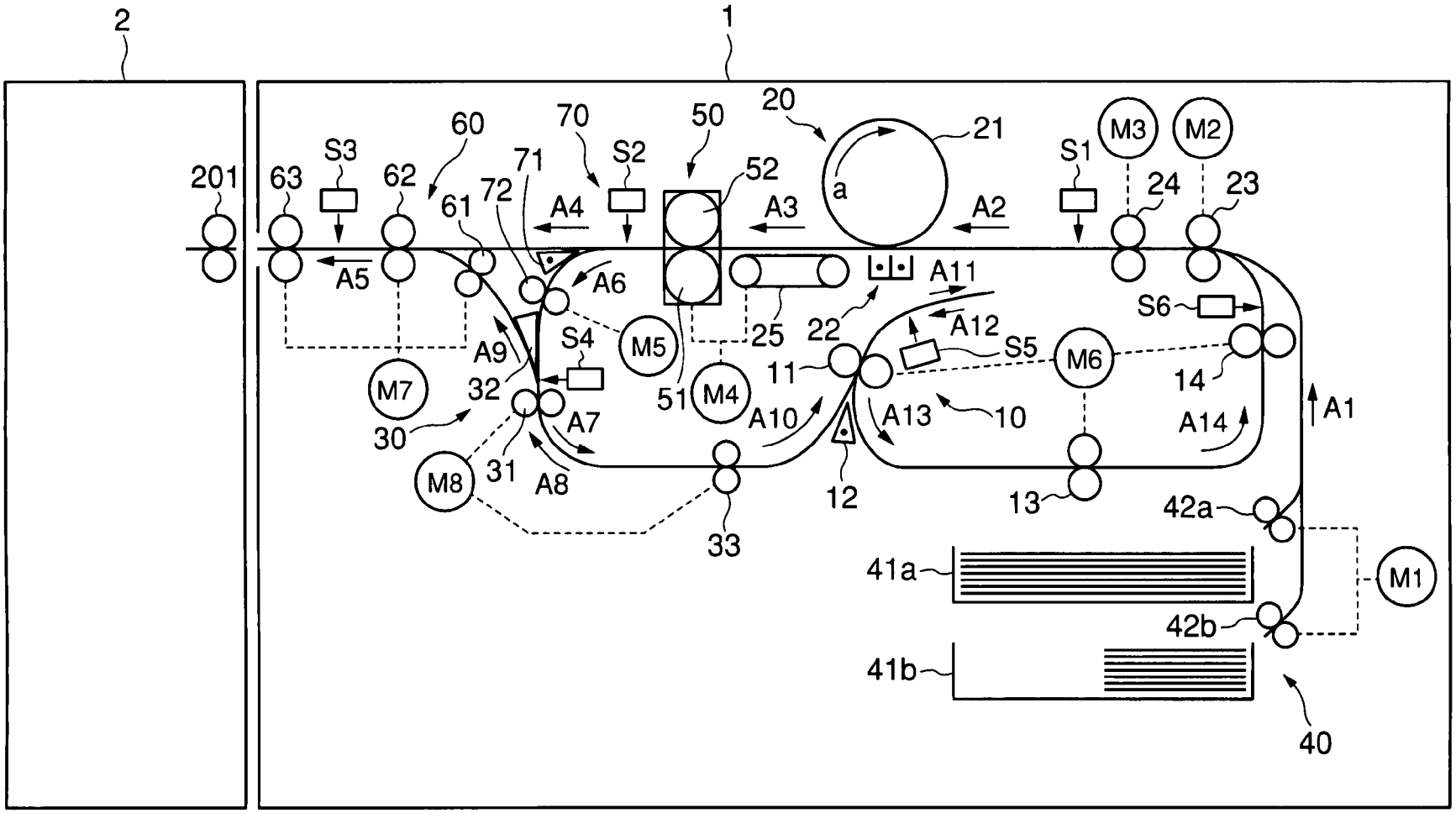
FIG. 1 is a sectional view showing the schematic overall arrangement of an image printing apparatus according to an embodiment of the present invention.

The arrangement of an image printing apparatus 1 according to an embodiment of the present invention will be described first with reference to FIG. 1. FIG. 1 is a sectional view showing the schematic overall arrangement of the image printing apparatus 1.

The image printing apparatus 1 performs printing operation in accordance with a delivery mode or a print mode. The delivery mode and the print mode will be described below. The print mode includes a "single-side image printing mode" of printing on only one surface (obverse surface) of a transfer sheet and delivering the sheet and a "duplex image printing mode" of printing on both surfaces (obverse and reverse surfaces) of a transfer sheet and delivering the sheet. The "single-side image printing mode" includes a "straight delivery mode" of delivering a transfer sheet with its printed surface facing upward and an "reverse delivery mode" of delivering a transfer sheet with its printed surface facing downward upon reversing the obverse and reverse surfaces of the sheet. In the "duplex image printing mode", a transfer sheet is delivered with its reverse surface facing upward. In summary, therefore, the delivery mode and the print mode include three modes, i.e., the "straight delivery mode", "reverse delivery mode", and "duplex image printing mode".

As shown in FIG. 1, the image printing apparatus 1 includes a feed section 40, image printing section 20, fixing section 50, switching portion 70, delivery section 60 (delivery convey section), reverse delivery section 30, reverse feed section 10. An image printing section of the present invention mainly includes the image printing section 20 and the fixing section 50.

The image printing section 20 mainly comprises a photosensitive drum 21. The photosensitive drum 21 is a rotating body, which is driven by a driving mechanism (not shown) to be rotated in the direction indicated by an arrow a. A transfer separation portion 22 is provided to face the photosensitive drum 21. Although not shown, a separating pawl, cleaner, eraser, charging electrode, laser exposure unit, and developing device are arranged around the photosensitive drum 21, starting from the transfer separation portion 22, along the rotating direction of the photosensitive drum 21. After the surface of the photosensitive drum 21 is discharged by the eraser, the surface is uniformly charged by the charging electrode to a predetermined potential with a predetermined polarity. An electrostatic latent image is then formed on the surface by scanning it with a laser beam. Subsequently, the electrostatic latent image is developed by the developing device to form a toner image. The transfer separation portion 22 transfers the toner image onto a transfer sheet and separates the sheet from the photosensitive drum 21.

The feed section 40 includes a plurality of feed trays 41 (two trays 41*a* and 41*b* in FIG. 1). Transfer sheets are selectively fed one by one from one of the feed trays 41 by a feed roller pair 42 (two rollers 42*a* and 42*b* in FIG. 1) driven by a feed motor M1 through a drive transmission mechanism (not shown). The fed sheet is conveyed in a direction A1 at a velocity Vs (fourth convey velocity) and is temporarily stopped when the leading edge of the transfer sheet reaches a registration roller pair 24.

The transfer sheet is lopped by and between a loop roller pair 23 driven by a loop motor M2 through a drive transmission mechanism (not shown) and the registration roller pair 24 driven by a registration motor M3 through a drive transmission mechanism (not shown). The transfer sheet is conveyed in a direction A2 at a velocity Vp (first convey velocity) at a predetermined timing and fed to the image printing section 20. Reference symbol S1 denotes a leading edge sensor (first detection portion) which detects a transfer sheet. This sensor is provided near the transfer separation portion 22, and more specifically, on the upstream side of the transfer separation portion 22. In this case, the velocity Vs may be equal to the velocity Vp.

The transfer separation portion 22 and the separating pawl transfer the toner image onto the transfer sheet and separate the sheet from the photosensitive drum 21. The transfer sheet is then conveyed in a direction A3 at the velocity Vp by a convey belt unit 25 driven by a fixing motor M4 through a drive transmission mechanism (not shown), and is fed to the fixing section 50. In this case, a convey belt is used as a convey member for transfer sheets instead of a roller pair. This is because, since a toner image is not fixed on a transfer sheet between the image printing section 20 and the fixing section 50, if the sheet is sandwiched between the roller pair, the toner image is disturbed, and the roller pair is stained by toner.

The fixing section 50 is comprised of a fixing roller (heat roller) 52 which includes a heat source such as a heater (not shown) and is heated by the heat source, a temperature sensor (not shown) which detects the temperature of the surface of the fixing roller 52, and a pressure roller 51 which is pressed against the fixing roller 52 by a pressure roller pressing mechanism as a biasing mechanism (not shown) to sandwich the transfer sheet together with the fixing roller 52. The transfer sheet is conveyed by the fixing roller 52, driven by the fixing motor M4, and the pressure roller 51 through a drive transmission mechanism (not shown) and is heated and pressurized to fix the toner image on the transfer sheet. The transfer sheet is then output from the fixing section, 50 to the switching portion 70. A fixing exit sensor S2 (second detection portion) which detects a transfer sheet is placed near the fixing section 50 (on the output side in this case). Note that the transfer sheet is conveyed at the velocity Vp at least until the trailing edge of the transfer sheet passes through the fixing exit sensor S2.

The switching portion 70 includes a switching guide 71 which is operated by a switching guide solenoid SOL1 (not shown) to switch the convey direction of a transfer sheet to a direction A4 or a direction A6 in accordance with the delivery mode or the print mode. The delivery section 60 is provided in the direction A4. The reverse delivery section 30 is provided in the direction A6.

A convey roller pair 72 driven by a switching motor M5 through a drive transmission mechanism (not shown) is provided in the direction A6 on the downstream side in the convey direction (which will sometimes be simply referred to as the downstream side with the omission of "in the convey direction", and likewise the upstream side in the convey direction will sometimes be simply referred to as the upstream side) of the switching guide 71. The convey roller pair 72 then feeds the transfer sheet to the reverse delivery section 30. In this case, the transfer sheet is accelerated at the timing set on the basis of the time required for image printing (this time is represented by T1) to be conveyed upon changing the convey velocity from the velocity Vp to a velocity Vr (third convey velocity) higher than velocity Vp (which will be described in detail later) (a change in velocity by acceleration will sometimes be simply referred to as "acceleration"). The velocity Vr is higher than the convey velocity Vs at the time of feed operation.

The reverse delivery section 30 comprises a reverse delivery guide 32 and convey roller pairs 31 and 33. The convey roller pairs 31 and 33 are driven by a reverse delivery motor M8 through a drive transmission mechanism (not shown) to convey a transfer sheet in a direction A7 or a direction A8. The reverse delivery guide 32 is moved by a reverse delivery guide solenoid SOL2 (not shown). That is, the reverse delivery guide 32 is moved to switch the convey path depending on whether a transfer sheet is conveyed from the convey roller pair 72 side to the direction A7 or a transfer sheet is conveyed in the direction A8 and is further conveyed in a direction A9 to be fed to the delivery section 60. The reverse delivery section 30 conveys the transfer sheet in the direction A7 at the velocity Vr, and then conveys the sheet at the velocity Vr upon switching the convey direction from the direction A8 to the direction A9, thereby reversing the obverse and reverse surfaces of the transfer sheet and delivering it. A reverse delivery sensor S4 (the third detection portion in the "reverse delivery mode") which detects a transfer sheet is placed between the reverse delivery guide 32 and the convey roller pair 31. When duplex image printing is to be performed, a transfer sheet is conveyed from the direction A7 to a direction A10 by the convey roller pairs 31 and 33 and fed to the reverse feed section 10. In addition, the reverse delivery section 30 serves as a reverse convey section of the present invention in the "reverse delivery mode".

The reverse feed section 10 comprises a reverse feed guide 12 and convey roller pairs 11, 13, and 14. The convey roller pairs 11, 13, and 14 are driven by a reverse feed motor M6 through a drive transmission mechanism (not shown) to convey the transfer sheet from a direction All or A12 to a direction A13 and to a direction A14 at the velocity Vr. The reverse feed guide 12 is operated by a reverse feed guide solenoid SOL3 (not shown) to switch the convey path depending on whether a transfer sheet is conveyed from the reverse delivery section 30 side to the direction A10 or a transfer sheet is conveyed in the direction A12 and further conveyed in the directions A13 and A14 to be fed to the convey roller pair 23. Upon conveying the transfer sheet in the direction All, the reverse feed section 10 switches the convey path from the direction A12 to the direction A13 to convey the transfer sheet upon reversing its obverse and reverse surfaces. With this operation, the image printing section 20 prints an image on the reverse surface of the transfer sheet again. In addition, a reverse feed sensor S5 (the third detection portion in the "duplex image printing mode") which detects a transfer sheet is placed on the back side of the convey roller pair 11, and a re-feed sensor S6 which detects a transfer sheet is placed on the downstream side of the convey roller pair 14. In this case, the transfer sheet is decelerated at the timing set on the basis of the time required for the reverse feed section 10 to reverse the transfer sheet (this time is represented by T2) after the leading edge of the transfer sheet passes through the re-feed sensor S6 (the fourth detection portion in the "duplex image printing mode") to be conveyed upon changing the convey velocity from the velocity Vr to the velocity Vs (which will be described in detail later) (a change in velocity by deceleration will sometimes be simply referred to as "deceleration" hereinafter). In addition, the reverse feed section 10 serves as a reverse convey section and re-feed section in the "duplex image printing mode" in the present invention.

The delivery section 60 comprises convey roller pairs 61 to 63 driven by a delivery motor M7 through a drive transmission mechanism (not shown). The delivery section 60 receives the transfer sheet conveyed from the fixing section 50 side or the reverse delivery section 30 side, and conveys and delivers the transfer sheet in the direction A5. A delivery sensor S3 which detects a transfer sheet is placed between the convey roller pairs 62 and 63. The velocity at which a transfer sheet is to be delivered is set on the basis of T1 when the "straight delivery mode" or the "duplex image printing mode" is to be set, or is set to a velocity Ve (the second convey velocity) on the basis of the time (represented by T3) required for the reverse delivery section 30 to perform reversing operation in the "reverse delivery mode" (which will be described in detail later).

This embodiment comprises a post-processing apparatus 2 which receives the transfer sheets delivered from the image printing apparatus 1 and performs bookbinding post-processing such as collation, stapling, and center folding/saddle stitching for the delivered transfer sheets. Reference numeral 201 denotes a reception roller which conveys a transfer sheet into the post-processing apparatus 2 at the delivery velocity at which the transfer sheet is delivered from the delivery section 60. A description of the internal mechanisms and arrangement of the post-processing apparatus 2 is omitted.

Figure 2:
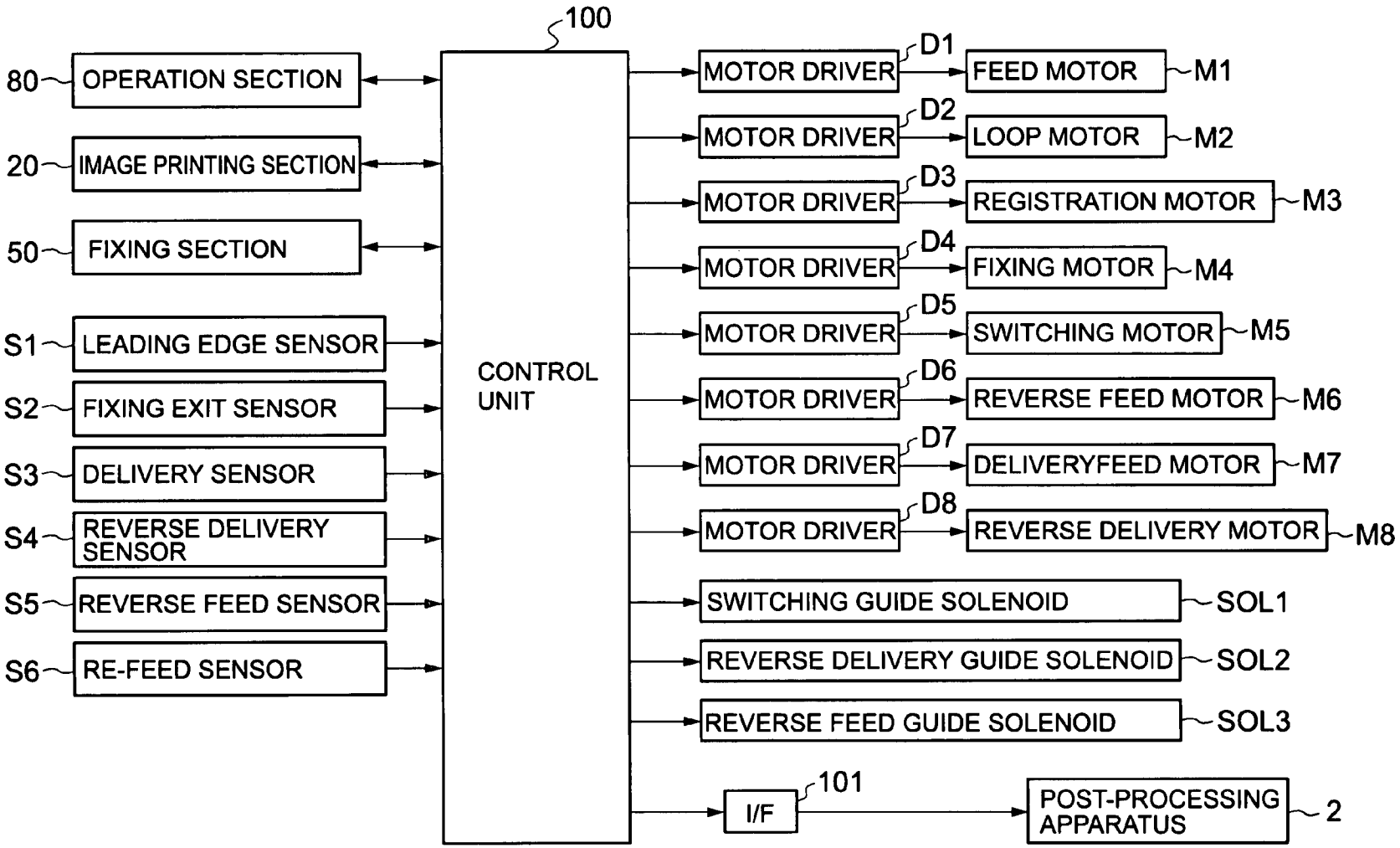
FIG. 2 is a block diagram showing the arrangement of the control system of the image printing apparatus according to the embodiment of the present invention.

Arrangement of Control System:

The arrangement of the control system of the present invention will be described next. FIG. 2 is a block diagram showing the arrangement of the control system of the image printing apparatus 1.

The operation section 80 is designed such that, for example, a touch panel which accepts operations and a display device comprising an LCD which displays patterns and characters are superimposed to allow an operator to perform various kinds of input operations by pressing the touch panel corresponding to the position displayed on the LCD. The operation section 80 has a function as an input unit for setting the delivery mode or the print mode and performing various kinds of input operations such as inputting a print start instruction.

The leading edge sensor S1, fixing exit sensor S2, delivery sensor S3, reverse delivery sensor S4, reverse feed sensor S5, and re-feed sensor S6 each comprise a photosensor or the like. Each of these sensors is designed to detect the presence/absence of a transfer sheet. For example, the leading edge of a transfer sheet is detected by a change from the state of the absence of the transfer sheet to the state of the presence of the transfer sheet due to the passage of the leading edge of the transfer sheet, and the trailing edge of a transfer sheet is detected by a change from the state of the presence of the transfer sheet to the state of the absence of the transfer sheet due to the passage of the trailing edge of the transfer sheet.

Motor drivers D1 to D8 respectively drive the feed motor M1, loop motor M2, registration motor M3, fixing motor M4, switching motor MS, reverse feed motor M6, delivery motor M7, and reverse delivery motor M8. The motor drivers D1 to D8 also receive velocity control clock signals sent from a control unit and drive the respective motors in accordance with the velocity control clock signals.

The switching guide solenoid SOL1, reverse delivery guide solenoid SOL2, and reverse feed guide solenoid SOL3 each comprise a DC solenoid. Each of the solenoids SOL1, SOL2, and SOL3 is operated in accordance with an ON-OFF signal sent from the control unit.

An I/F (interface) 101 serves to electrically connect the post-processing apparatus 2 to the image printing apparatus 1.

A control unit 100 controls the respective portions of the image printing apparatus 1. The control unit 100 also has a function as a first timepiece section which measures T1 described above, a function as a second timepiece section which measures T2 or T3, and a function as a convey condition setting unit which sets a timing at which the convey velocity of a transfer sheet is accelerated from Vp to Vr on the basis of T1, sets a timing at which the convey velocity of a transfer sheet is decelerated from Vr to Vs on the basis of T2, and sets the convey velocity Ve of a transfer sheet on the basis of T1 or T3.

Control operations for the measurement of T1, T2, and T3, T1 and the acceleration of the convey velocity of a transfer sheet from Vp to Vr, T2 and the deceleration of the convey velocity of a transfer sheet from Vr to Vs, and T1 or T3 and the delivery convey velocity of a transfer sheet will be described with reference to FIGS. 3 to 6. FIGS. 3 to 6 are timing charts showing the operations of the target sensors and target motors in the respective control operations.

Control on T1 and the timing of the acceleration of the convey velocity of a transfer sheet from the convey velocity Vp to the convey velocity Vr will be described first with reference to FIG. 3.

Figure 3:
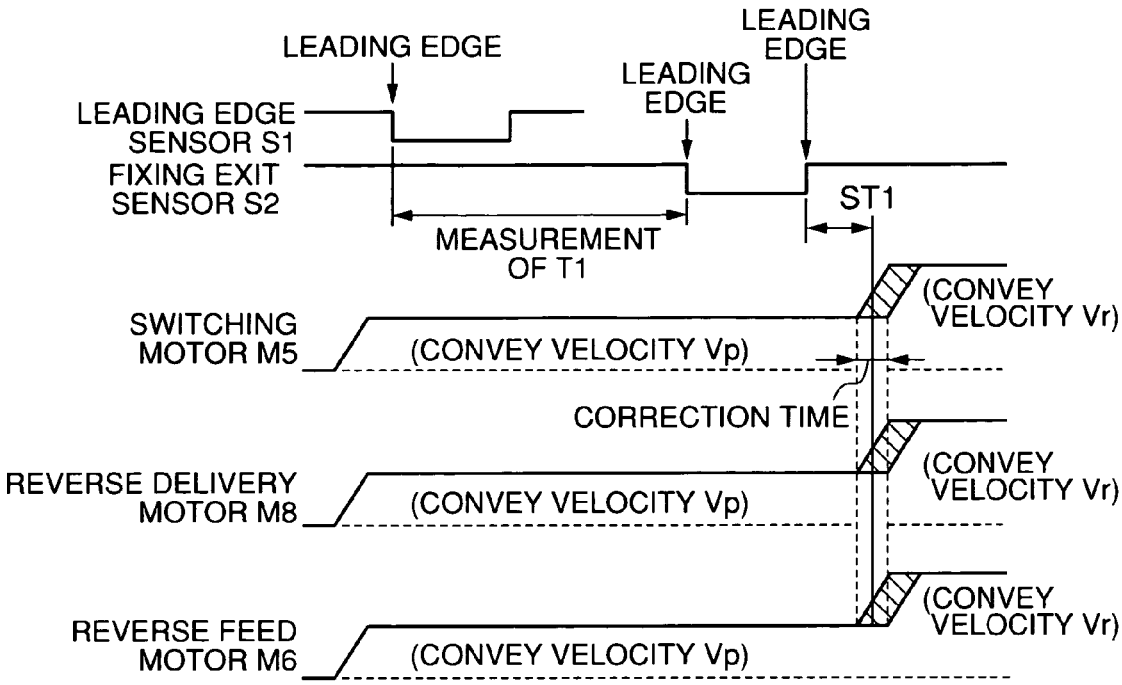
FIG. 3 is a timing chart showing an example of the operation of the image printing apparatus according to the embodiment of the present invention.

For example, as shown in FIG. 3, assume that the control unit 100 measures the time between the instant at which a transfer sheet is conveyed by the registration roller pair 24 and the leading edge sensor S1 detects the leading edge of the transfer sheet and the instant at which the transfer sheet is output from the fixing section 50 and the fixing exit sensor S2 detects the leading edge of the transfer sheet, and sets the measured time as T1.

In addition, for example, a reference value for T1 is set as the time obtained by dividing the distance from the leading edge sensor S1 to the fixing exit sensor S2 by the velocity Vp. Times for a plurality of steps before and after the reference value for T1 and correction times corresponding to the times for the plurality of steps are stored in advance in the form of a table in a memory or the like. This correction time is set as the difference between the time measurement result on T1 and its reference value, i.e., a value which cancels out a delay due to slip or the like. That is, if the time measurement result is larger than the reference value, the correction time takes a value that quickens the start of acceleration. If the time measurement result is smaller than the reference value, the correction time takes a value that delays the start of acceleration.

When T1 is equal to the reference value, the control unit 100 sets an acceleration start time indicating an acceleration timing as ST1, and controls the switching motor M5, reverse delivery motor M8, and reverse feed motor M6 to accelerate the convey velocity from Vp to Vr after the lapse of ST1 since the passage of the trailing edge of the transfer sheet through the fixing exit sensor S2. If T1 is not equal to the reference value, the control unit 100 searches the table in the memory for a correction time corresponding to the time measurement result on T1. As a consequence, the acceleration start time ST1 is corrected by the correction time to be changed to ST1'. The control unit 100 then controls the switching motor M5, reverse delivery motor M8, and reverse feed motor M6 to accelerate the convey velocity from Vp to Vr after the lapse of ST1' since the passage of the trailing edge of the transfer sheet through the fixing exit sensor S2. In this manner, acceleration is started at the timing corresponding to the hatching range shown in FIG. 3, i.e., T1.

Control on T2 and the timing of the deceleration of the convey velocity of a transfer sheet from the convey velocity Vr to the convey velocity Vs will be described next with reference to FIG. 4.

Figure 4:
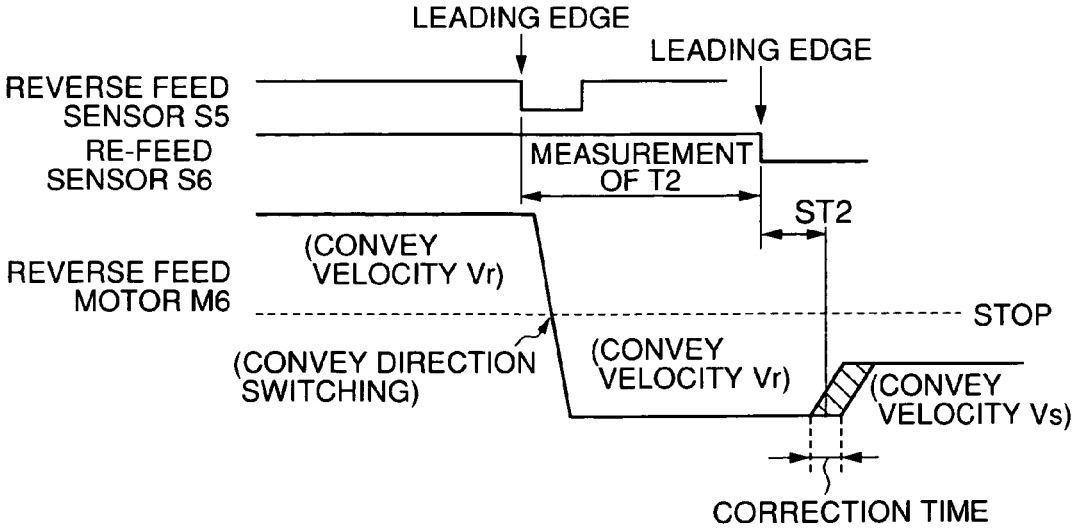
FIG. 4 is a timing chart showing an example of the operation of the image printing apparatus according to the embodiment of the present invention.

For example, as shown in FIG. 4, when a transfer sheet is conveyed in the direction All by the convey roller pair 11, the control unit 100 measures the time between the instant at which the reverse feed sensor S5 detects the leading edge of the transfer sheet and the instant at which the convey direction is switched from the direction All to the direction A12, the transfer sheet is conveyed in the directions A13 and A14, and the re-feed sensor S6 detects the leading edge of the transfer sheet, and sets the measured time as T2.

For example, a reference value for T2 is set as the time obtained by dividing the sum of the distance from the position of the reverse feed sensor S5 as a base point to the leading edge position of a transfer sheet which is conveyed in the direction All upon switching of the convey direction of the transfer sheet from the direction All to the direction A12 and the distance from the leading edge position of the transfer sheet which is conveyed in the direction A12 upon switching of the convey direction of the transfer sheet from the direction All to the direction A12 by the velocity Vr. Times for a plurality of steps before and after the reference value for T2 and correction times corresponding to the times for the plurality of steps are stored in advance in the form of a table in the memory or the like. This correction time is set as the difference between the time measurement result on T2 and its reference value, i.e., a value which cancels out a delay due to slip or the like. That is, if the time measurement result is larger than the reference value, the correction time takes a value that delays the start of deceleration. If the time measurement result is smaller than the reference value, the correction time takes a value that quickens the start of deceleration.

If T2 is equal to the reference value, the control unit 100 sets a deceleration start time indicating a deceleration timing as ST2, and controls the reverse feed motor M6 to decelerate the convey velocity from Vr to Vs after the lapse of ST2 since the passage of the leading edge of the transfer sheet through the re-feed sensor S6. If T2 is not equal to the reference value, the control unit 100 searches the table in the memory for a correction time corresponding to the time measurement result on T2. As a consequence, the deceleration start time is changed to ST2' corrected by the correction time. The control unit 100 then controls the reverse feed motor M6 to decelerate the convey velocity of the transfer sheet from Vr to Vs after the lapse of ST2' since the passage of the leading edge of the transfer sheet through the re-feed sensor S6. In this manner, deceleration is started at the timing corresponding to the hatching range shown in FIG. 4, i.e., T2.

Control on T1 or T3 and the convey velocity for the delivering of a transfer sheet will be described lastly.

Figure 5:
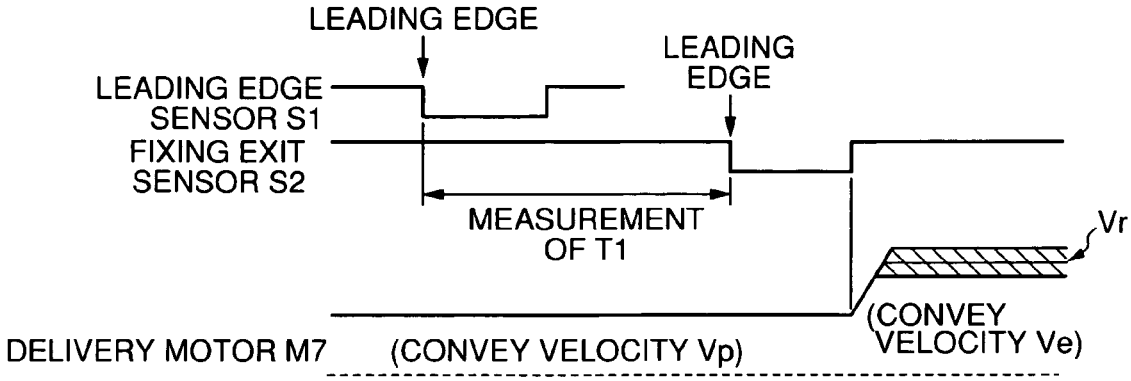
FIG. 5 is a timing chart showing an example of the operation of the image printing apparatus according to the embodiment of the present invention.

Control based on T1 (in the case of the "straight delivery mode" and "duplex image printing mode") will be described first with reference to FIG. 5. The control unit 100 measures T1 in this case in the same manner as in the above description of the acceleration of the convey velocity of a transfer sheet from Vp to Vr on the basis of T1.

For example, times for a plurality of steps before and after the reference value for T1 and delivery convey velocities Ve corresponding to the times for the plurality of steps are stored in advance in the form of a table in the system memory or the like. The delivery convey velocity Ve is set as the difference between the time measurement result on T1 and its reference value, i.e., a velocity which cancels out a delay due to slip or the like. That is, if the time measurement result is larger than the reference value, it is determined that the delivery convey velocity Ve is higher than a predetermined velocity (Vr in this case) corresponding to the reference value. If the time measurement result is smaller than the reference value, it is determined that the delivery convey velocity Ve is lower than the predetermined velocity corresponding to the reference value.

If it is determined by searching the table in the memory that T1 is equal to the reference value, the control unit 100 controls the delivery motor M7 to change the delivery convey velocity from Vp to Ve corresponding the reference value when the trailing edge of the transfer sheet passes through the fixing exit sensor S2. If it is determined that T1 is not equal to the reference value, the control unit 100 obtains the convey velocity Ve corresponding to the time measurement result on T1. As a consequence, the control unit 100 controls the delivery motor M7 to change the delivery convey velocity of the transfer sheet to the obtained delivery convey velocity Ve when the trailing edge of the transfer sheet passes through the fixing exit sensor S2. In this manner, the delivery convey velocity falls within the hatching range shown in FIG. 5.

Control operation based on T3 (in the case of the "reverse delivery mode") will be described next with reference to FIG. 6.

Figure 6:
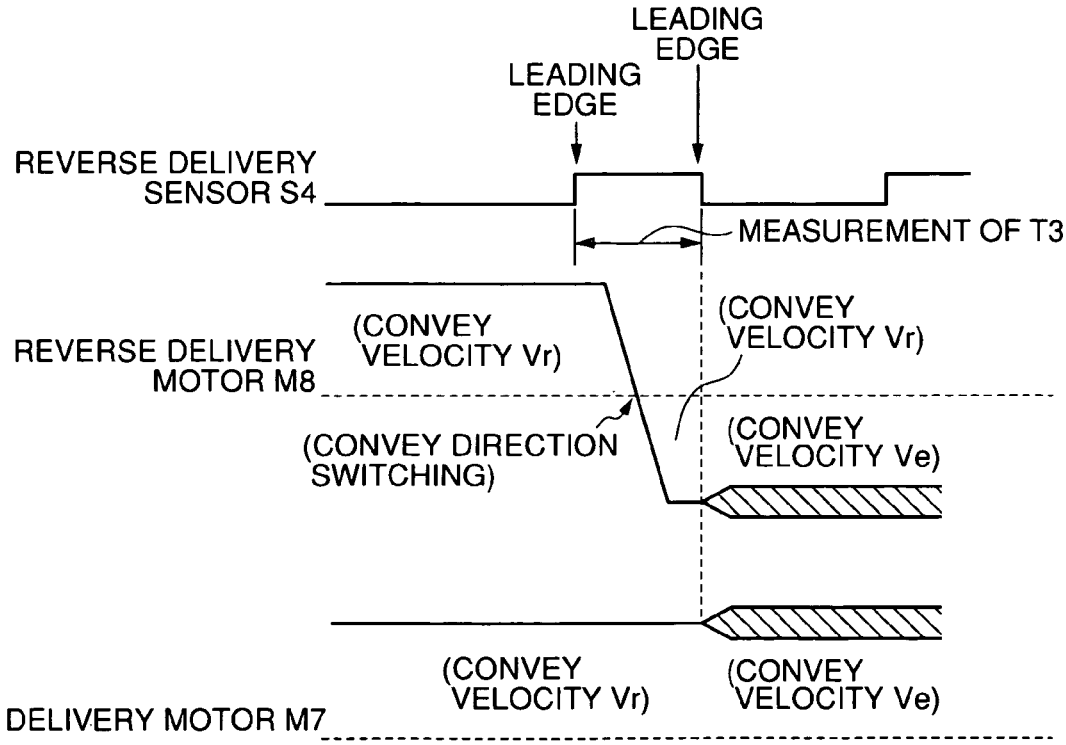
FIG. 6 is a timing chart showing an example of the operation of the image printing apparatus according to the embodiment of the present invention.

For example, as shown in FIG. 6, when a transfer sheet is conveyed by the convey roller pair 31 in the direction A7 at the convey velocity Vr, the trailing edge of the transfer sheet is detected by the reverse delivery sensor S4. When the convey direction is switched from the direction A7 to the direction A8 and the transfer sheet is conveyed in the direction A9 at the convey velocity Vr, the leading edge of the transfer sheet is detected by the reverse delivery sensor S4. The control unit 100 measures the time between the above detection of the trailing edge of the transfer sheet and the detection of the leading edge. This time measurement result is set as T3.

For example, a reference value for T3 is set as the time obtained by dividing a distance twice the distance from the position of the reverse feed sensor S5 as a base point to the leading edge position of a transfer sheet conveyed in the direction A8 upon switching of the convey direction of the transfer sheet from the direction A7 to the direction A8 by the velocity Vr. Times for a plurality of steps before and after the reference value for T3 and delivery convey velocities Ve corresponding to the times for the plurality of steps are stored in advance in the form of a table in the system memory or the like. The delivery convey velocity Ve is set as the difference between the time measurement result on T3 and its reference value, i.e., a velocity which cancels out a delay due to slip or the like. That is, if the time measurement result is larger than the reference value, it is determined that the delivery convey velocity Ve is higher than a predetermined velocity (Vr in this case) corresponding to the reference value. If the time measurement result is smaller than the reference value, it is determined that the delivery convey velocity Ve is lower than the predetermined velocity corresponding to the reference value.

If it is determined by searching the table in the memory that T3 is equal to the reference value, the control unit 100 controls the reverse delivery motor M8 and the delivery motor M7 to change the delivery convey velocity from Vr to the predetermined velocity corresponding the reference value when the leading edge of the transfer sheet passes through the reverse delivery sensor S4. If it is determined that T3 is not equal to the reference value, the control unit 100 obtains the convey velocity Ve corresponding to the time measurement result on T3. As a consequence, the control unit 100 controls the reverse delivery motor M8 and the delivery motor M7 to change the delivery convey velocity of the transfer sheet to the obtained delivery convey velocity Ve when the leading edge of the transfer sheet passes through the reverse delivery sensor S4. In this manner, the delivery convey velocity falls within the hatching range shown in FIG. 6.

Performing control operations for T1 and the acceleration of the convey velocity of a transfer sheet from Vp to Vr, T2 and the deceleration of the convey velocity of a transfer sheet from Vr to Vs, and T1 or T3 and the delivery convey velocity of a transfer sheet in the above manner makes it possible to correct variations in the distance between transfer sheets due to the slip of a transfer sheet on the convey belt unit 25, the slip of a transfer sheet when it enters between the fixing roller 52 and the pressure roller 51, the slip of a transfer sheet when it is reversed by the reverse delivery section 30 and the reverse feed section 10, and the like as described above, or variations in convey start time due to variations in the loop shape formed between the loop roller pair 23 and the registration roller pair 24.

The above measurement of T1, T2, and T3 is only an example, and the present invention is not limited to this. In addition, setting of acceleration timings, deceleration timings, and delivery velocities is not limited to the above technique using a table. For example, corresponding computation units may be provided to obtain such information in each case.

The control unit 100 also has a function as a notifying unit which notifies, through the I/F 101, the post-processing apparatus 2 of transfer sheet information associated with a transfer sheet or transfer sheet conveyance, such as the delivery convey velocity Ve, an inter-sheet distance, the presence/absence of skew, a paper type, and a size, as a state set when the convey velocity is changed to the delivery convey velocity Ve.

In order to implement these functions, the control unit 100 comprises a CPU (not shown), the above table, various kinds of programs, and a system memory (not shown) which stores various kinds of data necessary for the execution of the programs and provides a work area used for the execution of various kinds of programs.

Operation Forms of Image Printing Apparatus

Figure 7:
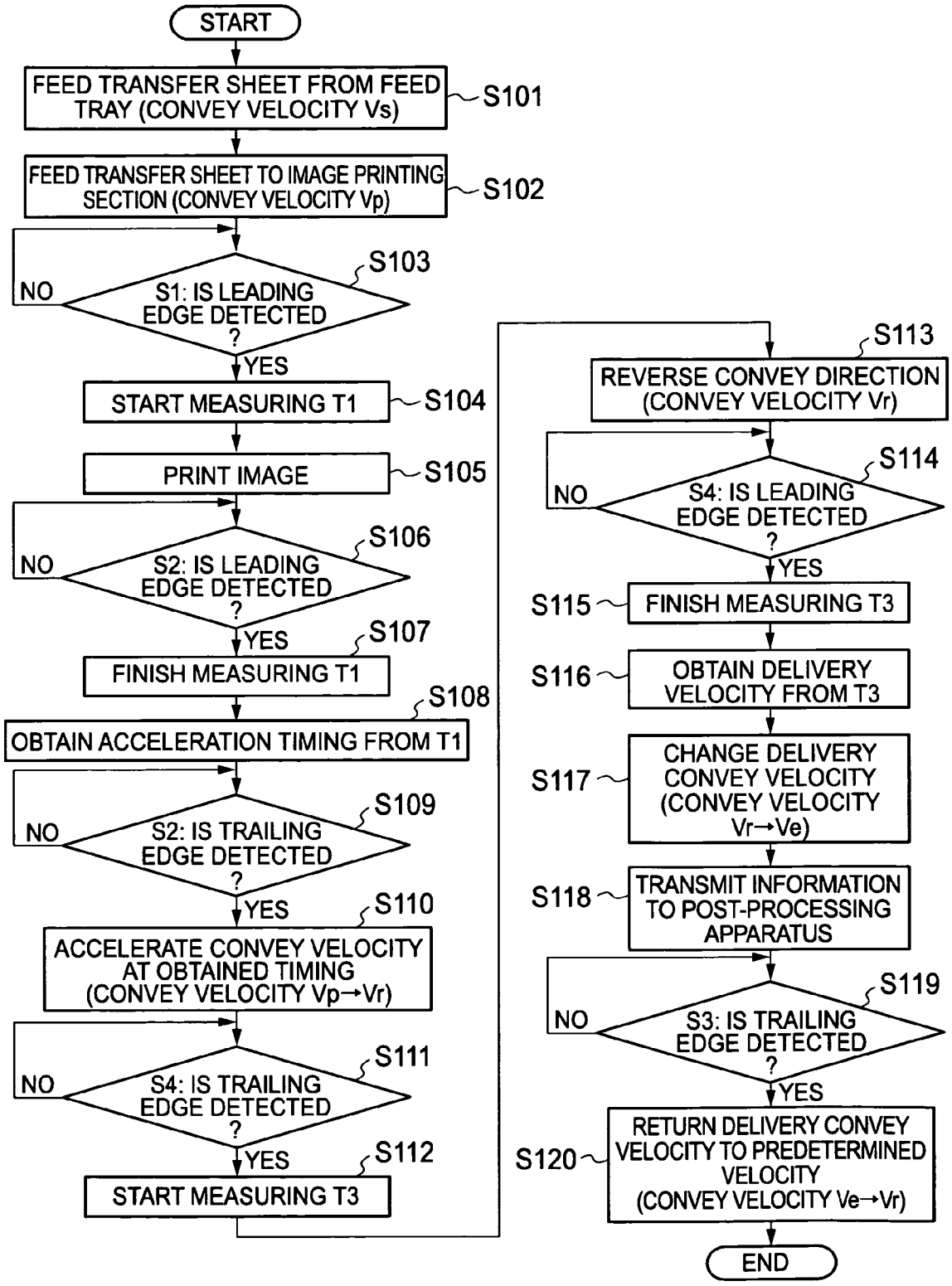
FIG. 7 is a flowchart showing an example of the operation form of the image printing apparatus in the reverse delivery mode according to the embodiment of the present invention.
Figure 8:
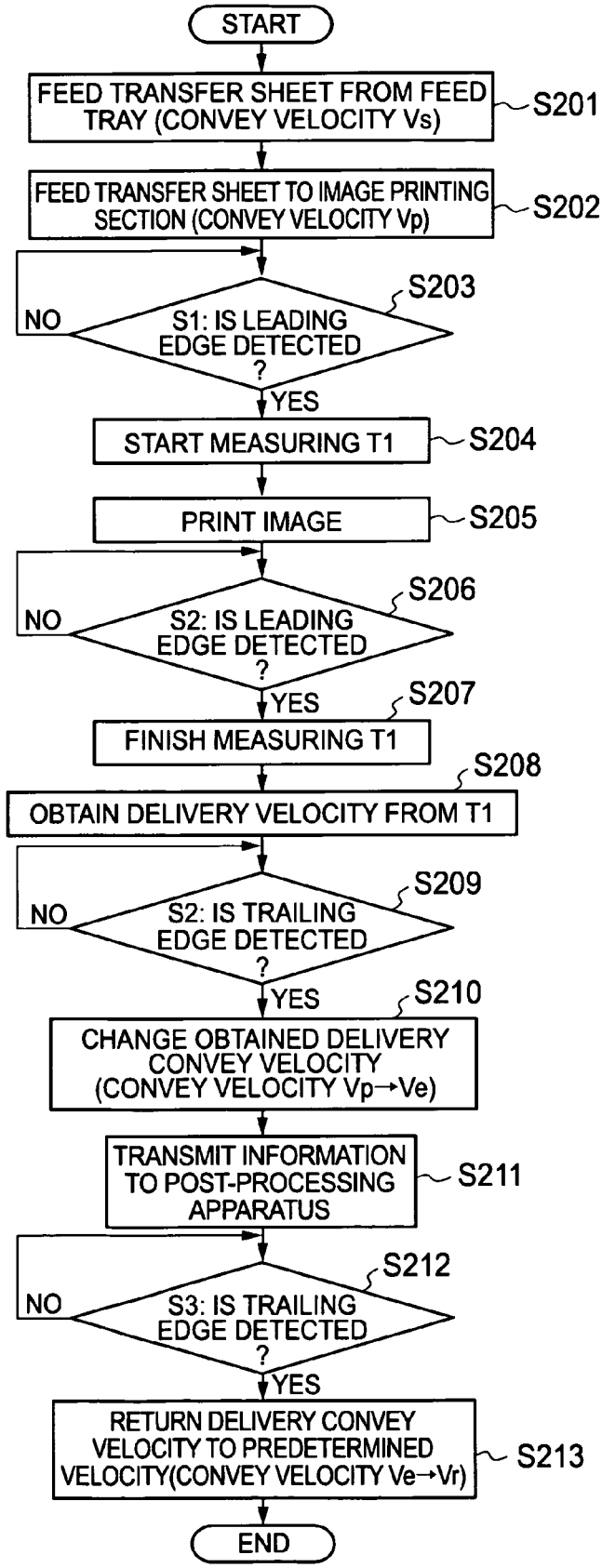
FIG. 8 is a flowchart showing an example of the operation form of the image printing apparatus in the straight delivery mode according to the embodiment of the present invention.
Figure 9:
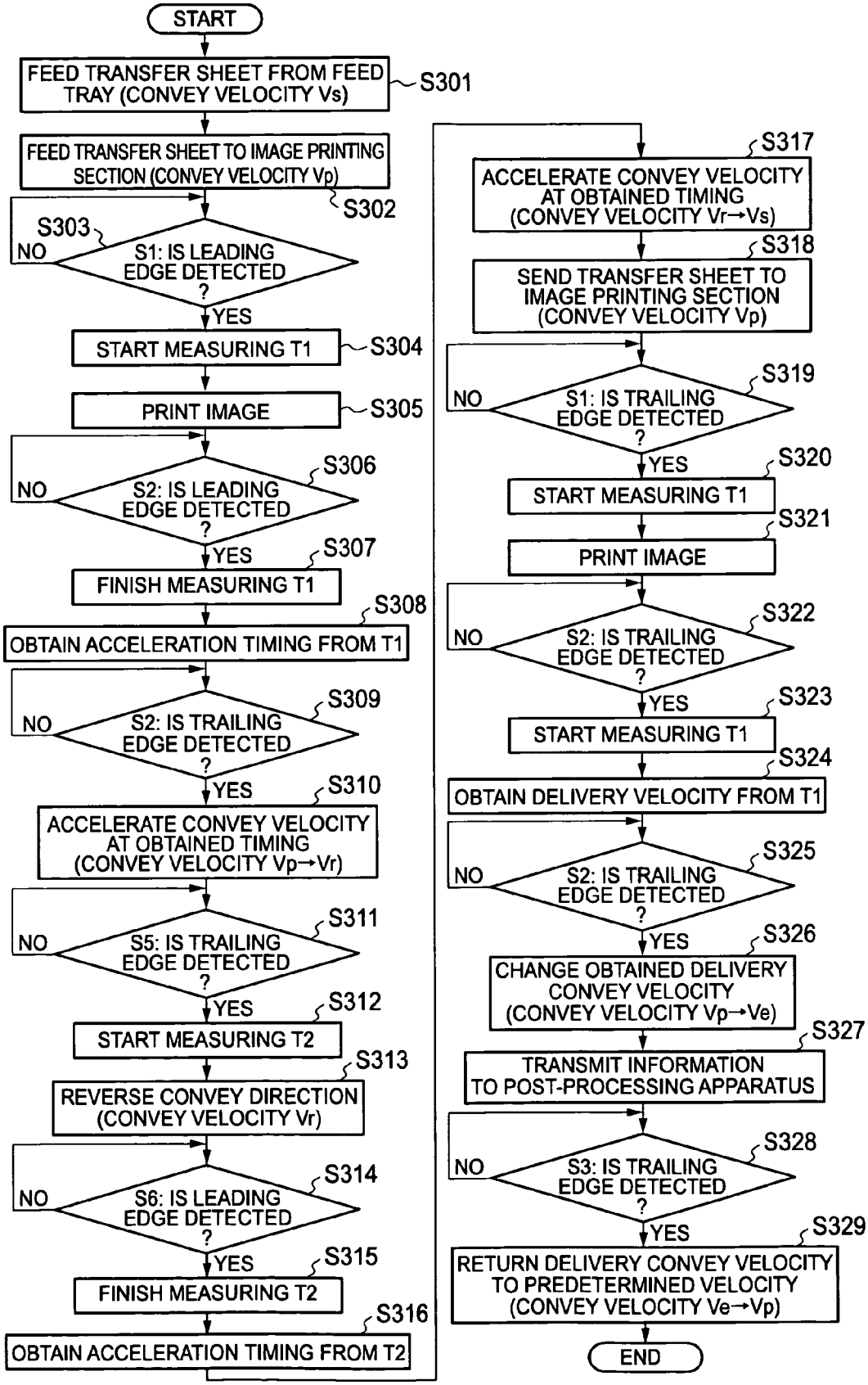
FIG. 9 is a flowchart showing an example of the operation form of the image printing apparatus in the duplex image printing mode according to the embodiment of the present invention.

Operation forms in the respective modes of the image printing apparatus 1 according to an embodiment of the present invention will be described with reference to FIGS. 7 to 9. FIGS. 7 to 9 are flowcharts respectively showing examples of the operations in the respective modes of the image printing apparatus 1. FIG. 7 shows an example of the operation in the "reverse delivery mode". FIG. 8 shows an example of the operation in the "straight delivery mode". FIG. 9 shows an example of the operation in the "duplex image printing mode". Each flowchart shows processing to be performed for one transfer sheet in the interval between feed operation and delivery operation. One of these modes is selected on the basis of input by an operator using an operation section 80.

Operation in each mode will be described below.

1. Reverse Delivery Mode

Referring to FIG. 7, first of all, the control unit 100 controls the feed motor M1 to operate the feed roller pair 42, thereby feeding a transfer sheet from one of the feed trays 41. The control unit 100 further controls the loop motor M2 to operate the loop roller pair 23 so as to convey the transfer sheet in the direction A1 at the convey velocity Vs. When the leading edge of the transfer sheet is conveyed to reach the registration roller pair 24, the feed motor M1 and the loop motor M2 are temporarily stopped (step S101) (subsequently, step S101 will be abbreviated as S101; ditto for the remaining steps). Although subsequent transfer sheet feed will be described below, transfer sheets as subsequent pages will be sequentially fed at predetermined intervals.

The control unit 100 controls the loop motor M2 and the registration motor M3 to loop a transfer sheet between the loop roller pair 23 and the registration roller pair 24, and further controls the motors to convey the transfer sheet in the direction A2 at the velocity Vp at a predetermined timing (S102).

If the leading edge sensor S1 detects the leading edge of the transfer sheet (Y in S103), the control unit 100 starts measuring T1 as described with reference to FIG. 3 (S104).

The transfer sheet is conveyed at the velocity Vp, and a toner image is transferred and fixed on the transfer sheet (S105). In this case, the control unit 100 controls the switching motor M5, reverse delivery motor M8, reverse feed motor M6, switching guide solenoid SOL1, reverse delivery guide solenoid SOL2, and reverse feed guide solenoid SOL3 to convey the transfer sheet in the directions A6, A7, and A10 at the convey velocity Vp. If the fixing exit sensor S2 detects the leading edge of the transfer sheet (Y in S106), the control unit 100 finishes measuring T1 (S107) and obtains an acceleration start time corresponding to T1 (S108), as described with reference to FIG. 3. The transfer sheet is further conveyed by the convey roller pair 72, the convey roller pairs 31 and 33, and the like, and the trailing edge of the transfer sheet is detected by the fixing exit sensor S2 (Y in S109), as described with reference to FIG. 3. When the acceleration start time obtained in S108 has elapsed, the control unit 100 controls the switching motor M5, reverse delivery motor M8, and reverse feed motor M6 to accelerate the convey velocity of the transfer sheet from Vp to Vr (S110).

The transfer sheet is further conveyed, and the trailing edge of the transfer sheet is detected by the reverse delivery sensor S4 (Y in S111). At this time, as described with reference to FIG. 6, the control unit 100 starts measuring T3 (S112), and controls the reverse delivery motor M8, reverse feed motor M6, and reverse delivery guide solenoid SOL2, when the transfer sheet is further conveyed for a predetermined period time, so as to convey the transfer sheet in the directions A8 and A9 at the convey velocity Vr (S113). If the reverse delivery sensor S4 detects the leading edge of the transfer sheet (the trailing edge of the transfer sheet conveyed in the direction A7) (Y in S114), the control unit 100 finishes measuring T3 (Sl15), and obtains the delivery convey velocity Ve (Sl16), as described with reference to FIG. 6. The control unit 100 then controls the reverse delivery motor M8, reverse feed motor M6, and delivery motor M7 to change the convey velocity to the convey velocity Ve (S117), and transmits transfer sheet information to the post-processing apparatus 2 (S118). By transmitting the transfer sheet information to the post-processing apparatus 2 in this manner, the post-processing apparatus 2 can control its operation on the basis of the transfer sheet information. Therefore, no problem arises when the post-processing apparatus 2 receives the transfer sheet.

When the transfer sheet is then conveyed through the convey roller pairs 61 to 63 and the like and the delivery sensor S3 detects the trailing edge of the transfer sheet (Y in S119), the control unit 100 controls the reverse delivery motor M8 to change the convey velocity to Vr (predetermined convey velocity) after the transfer sheet is conveyed for a predetermined period of time (S120).

2. Straight Delivery Mode:

S201 to S207 in FIG. 8 correspond to S101 to S107 in FIG. 7, and T1 is measured in the same manner as in the reverse delivery mode. The control unit 100 obtains the delivery convey velocity Ve (S208). The transfer sheet is subjected to fixing and the like while being conveyed at the velocity Vp, and the control unit 100 controls the delivery motor M7 and the switching guide solenoid SOL1 to convey the transfer sheet in the directions A4 and AS through the convey roller pairs 62 and 63 and the like. When the fixing exit sensor S2 then detects the trailing edge of the transfer sheet (Y in S209), the control unit 100 controls the delivery motor M7 to change the delivery convey velocity from Vp to the obtained velocity Ve (S210), as described with reference to FIG. 5.

As in the reverse delivery mode shown in FIG. 7, transfer sheet information is transmitted to the post-processing apparatus 2 (S211). When the transfer sheet is conveyed by the convey roller pairs 62 and 63 and the like and the delivery sensor S3 detects the trailing edge of the transfer sheet (Y in S212), the control unit 100 controls the reverse delivery motor M8 to change the convey velocity to Vp after the transfer sheet is conveyed for a predetermined period of time (S213).

3. Duplex Image Printing Mode:

S301 to S310 in FIG. 9 correspond to S101 to S107 in FIG. 7. As in the reverse delivery mode, a transfer sheet is conveyed while the convey velocity is accelerated from Vp to Vr. If the reverse feed sensor S5 detects the leading edge of the transfer sheet (Y in S311), the control unit 100 starts measuring T2 (S312), as described with reference to FIG. 4. When the transfer sheet is further conveyed for a predetermined period of time, the control unit 100 controls the reverse feed motor M6 and reverse feed guide solenoid SOL3 to convey the transfer sheet in the directions A13 and A14 at the convey velocity Vr (S313). If the re-feed sensor S6 detects the leading edge of the transfer sheet (the trailing edge of the transfer sheet conveyed in the direction A10) (Y in S314), the control unit 100 finishes measuring T2 (S315), and obtains a deceleration start time (S316), as described with reference to FIG. 4. When the deceleration start time has elapsed, the control unit 100 controls the reverse feed motor M6 to decelerate the convey velocity from Vr to Vs. At the same time, the control unit 100 controls the loop motor M2 to operate the loop roller pair 23 so as to convey the transfer sheet in the direction A1 at the convey velocity Vs. When the transfer sheet is conveyed until the leading edge of the transfer sheet reaches the registration roller pair 24, the control unit 100 temporarily stops the reverse feed motor M6 and the loop motor M2 (S317). In this case, T2 is measured by using the detection results obtained by the reverse feed sensor S5 and re-feed sensor S6. However, this measurement can be performed by making use of the reverse feed sensor S5 in the same manner as, for example, the measurement of T3 by the reverse delivery sensor S4.

Printing on the reverse surface is then started. S318 to S329 in FIG. 9 correspond to S202 to S213 in FIG. 8. Image printing on a transfer sheet and delivery operation are performed in the same manner as in the straight delivery mode. With regard to transfer sheet feed in the duplex image printing mode, when printing on the reverse surface of a transfer sheet as a preceding page is started, the next page is fed at a predetermined interval from the transfer sheet as the preceding page.

As has been described above, according to the present invention, variations in the distance between transfer sheets can be corrected. It is therefore unnecessary to provide an excessive margin of an inter-sheet distance in consideration of variations. This makes it possible to improve the image printing efficiency by decreasing the inter-sheet distance. In addition, since transfer sheets are delivered with a stable inter-sheet distance, processing in the post-processing apparatus is facilitated.

What is claimed is:

1. An image printing apparatus comprising:

an image printing section configured to perform image printing by conveying a transfer sheet at a first convey velocity and perform transferring and fixing of a toner image on the transfer sheet;

a control unit including a timepiece section configured to measure a time required for said image printing section to perform image printing, the control unit configured to:

determine a second convey velocity based on the time measured by the timepiece section; and change the first convey velocity for conveying the transfer sheet to the second convey velocity; and a delivery convey section configured to receive the transfer sheet on which image printing is performed by the image printing section and convey and deliver the transfer sheet upon changing the first convey velocity to the second convey velocity.

2. An apparatus according to claim 1, further comprising a first detection portion which is provided near a position where the transferring is performed, and is configured to detect the transfer sheet, and a second detection portion which is provided near a position where the fixing is performed, and is configured to detect the transfer sheet, wherein said timepiece section is configured to measure a time required for the image printing on the basis of detection results obtained by said first detection portion and said second detection portion.

3. An apparatus according to claim 1, further comprising a post-processing apparatus configured to receive the delivered transfer sheet and perform post-processing, and a notifying unit configured to notify said post-processing apparatus of a state of the transfer sheet when the first convey velocity is changed to the second convey velocity.

4. An image printing apparatus comprising:

an image printing section configured to perform image printing by sequentially conveying a plurality of transfer sheets at predetermined intervals at a first convey velocity and perform transferring and fixing of a toner image on each transfer sheet;

a control unit including a timepiece section configured to measure a time required for said image printing section to perform image printing on said each transfer sheet, the control unit configured to:

determine a second convey velocity based on the time measured by the timepiece section; and change the first convey velocity for conveying said each transfer sheet to the second convey velocity; and a delivery convey section configured to receive said each transfer sheet on which image printing is performed by said imaging image printing section and deliver said each transfer sheet while adjusting intervals therebetween by conveying said each transfer sheet upon changing the first convey velocity to the second convey velocity.

5. An apparatus according to claim 4, further comprising a first detection portion which is provided near a position where the transferring is performed, and is configured to detect said each transfer sheet, and a second detection portion which is provided near a position where the fixing is performed, and is configured to detect said each transfer sheet, wherein said timepiece section is configured to measure a time required for the image printing on the basis of detection results obtained by said first detection portion and said second detection portion.

6. An apparatus according to claim 4, further comprising a post-processing apparatus configured to receive delivered said each transfer sheet and perform post-processing, and a notifying unit configured to notify said post-processing apparatus of a state of said each transfer sheet when the first convey velocity is changed to the second convey velocity.

7. An image printing apparatus comprising:

an image printing section configured to perform image printing by conveying a transfer sheet at a first convey velocity and perform transferring and fixing of a toner image on the transfer sheet;

a control unit including:

a first timepiece section configured to measure a first time required for said image printing section to perform image printing; and a second timepiece section configured to measure a second time required for a reverse convey section to perform conveyance including reversing, the control unit configured to:

determine a second convey velocity based on the second time measured by the second timepiece section and required for conveyance including reversing; and change the first convey velocity for conveying the transfer sheet to the second convey velocity;

wherein, the reverse convey section is configured to receive the transfer sheet on which image printing is performed by said image printing section, convey the transfer sheet upon changing a velocity by accelerating the velocity at a timing set on the basis of the first time measured by said first timepiece section and required for the image printing, and reverse an obverse surface and reverse surface of the transfer sheet while reversing a convey direction of the transfer sheet; and a delivery convey section configured to receive the transfer sheet reversed by said reverse convey section and convey and deliver the transfer sheet upon changing the first convey velocity to the second convey velocity.

8. An apparatus according to claim 7, further comprising a first detection portion which is provided near a position where the transferring is performed, and is configured to detect the transfer sheet, a second detection portion which is provided near a position where the fixing is performed, and is configured to detect the transfer sheet, and a third detection portion which is provided near a position where the reversing is performed, and is configured to detect the transfer sheet, wherein said first timepiece section measures a time required for the image printing on the basis of detection results obtained by said first detection portion and said second detection portion, and said second time piece section measures a time required for conveyance including the reversing on the basis of detection results obtained by said second timepiece section and said third detection portion.

9. An apparatus according to claim 7, further comprising a post-processing apparatus configured to receive the delivered transfer sheet and perform post-processing, and a notifying unit configured to notify said post-processing apparatus of a state of the transfer sheet when the first convey velocity is changed to the second convey velocity.

10. An image printing apparatus comprising:

an image printing section configured to perform image printing by sequentially conveying a plurality of transfer sheets at predetermined intervals at a first convey velocity and perform transferring and fixing of a toner image on each transfer sheet;

a control unit including:

a first timepiece section configured to measure a first time required for said image printing section to perform image printing on said each transfer sheet; and a second timepiece section configured to measure a second time required for a reverse convey section to perform conveyance including reversing, the control unit configured to:

determine a second convey velocity based on the second time measured by the second timepiece section and required for conveyance including reversing; and change the first convey velocity for conveying said each transfer sheet to the second convey velocity;

wherein, the reverse convey section is configured to receive said each transfer sheet on which image printing is performed by said image printing section, convey said each transfer sheet upon changing the first convey velocity by acceleration at a timing set on the basis of the first time measured by said first timepiece section and required for the image printing on said each transfer sheet, and reverse the obverse surface and reverse surface of said each transfer sheet while reversing a convey direction of said each transfer sheet; and a delivery convey section configured to receive said each transfer sheet reversed by said reverse convey section and convey and deliver said each transfer sheet upon changing the first convey velocity to the second convey velocity, wherein the transfer sheets are delivered while intervals between the transfer sheets are adjusted by said reverse convey section and said delivery convey section.

11. An apparatus according to claim 10, further comprising a first detection portion which is provided near a position where the transfer is performed, and is configured to detect said each transfer sheet, a second detection portion which is provided near a position where the fixing is performed, and is configured to detect said each transfer sheet, and a third detection portion which is provided near a position where the reversing is performed, and is configured to detect said each transfer sheet, wherein said first timepiece section measures a time required for the image printing on the basis of detection results obtained by said first detection portion and said second detection portion, and said second timepiece section measures a time required for conveyance including the reversing on the basis of detection results obtained by said second timepiece section and said third detection portion.

12. An apparatus according to claim 10, further comprising a post-processing apparatus configured to receive delivered said each transfer sheet and perform post-processing, and a notifying unit configured to notify said post-processing apparatus of a state of said each transfer sheet when the first convey velocity is changed to the second convey velocity.

13. An image printing apparatus comprising:

an image printing section configured to perform image printing by conveying a transfer sheet at a first convey velocity and perform transferring and fixing of a toner image on the transfer sheet;

a control unit including:

a first timepiece section configured to measure a first time required for said image printing section to perform image printing; and a second timepiece section configured to measure a second time required for a reverse convey section to perform conveyance including reversing, the control unit configured to:

determine a second convey velocity based on the second time measured by the second timepiece section and required for conveyance including reversing; and change the first convey velocity for conveying the transfer sheet to the second convey velocity;

wherein, the reverse convey section is configured to receive the transfer sheet having an obverse surface on which image printing is performed by said image printing section, convey the transfer sheet upon changing the first convey velocity to a third convey velocity by acceleration at a timing set on the basis of the first time measured by said first timepiece section and required for image printing on the obverse surface of the transfer sheet, and reverse obverse and reverse surfaces of the transfer sheet while reversing a convey direction of the transfer sheet;

a re-feed section configured to receive the transfer sheet reversed by said reverse convey section, convey the transfer sheet upon changing the third convey velocity to a fourth convey velocity by deceleration at a timing set on the basis of the second time measured by said second timepiece section and required for conveyance including the reversing, and feed the transfer sheet again to said image printing section; and a delivery convey section configured to receive the transfer sheet having a reverse surface on which image printing is performed by said image printing section, and convey and deliver the transfer sheet upon changing the first convey velocity to the second convey velocity.

14. An apparatus according to claim 13, further comprising a first detection portion which is provided near a position where the transferring is performed, and is configured to detect the transfer sheet, a second detection portion which is provided near a position where the fixing is performed, and is configured to detect the transfer sheet, and a third detection portion which is provided near a position where the reversing is performed, and is configured to detect the transfer sheet, wherein said first measuring portion measures a time required for image printing on the observe surface and the reverse surface on the basis of detection results obtained by said first detection portion and said second detection portion, and said second timepiece section measures a time required for conveyance including the reversing on the basis of at least a detection result obtained by said third detection portion.

15. An apparatus according to claim 13, wherein the fourth convey velocity is equal to the first convey velocity.

16. An apparatus according to claim 13, further comprising a post-processing apparatus configured to receive the delivered transfer sheet and perform post-processing, and a notifying unit configured to notify said post-processing apparatus of a state of the transfer sheet when the first convey velocity is changed to the second convey velocity.

17. An image printing apparatus comprising:

an image printing section configured to perform image printing by sequentially conveying a plurality of transfer sheets at predetermined intervals at a first convey velocity and perform transferring and fixing of a toner image on each transfer sheet;

a control unit including:

a first timepiece section configured to measure a first time required for said image printing section to perform image printing on said each transfer sheet; and a second timepiece section configured to measure a second time required for a reverse convey section to perform conveyance including reversing of said each transfer sheet, the control unit configured to:

determine a second convey velocity based on the second time measured by the second timepiece section and required for conveyance including reversing; and change the first convey velocity for conveying said each transfer sheet to the second convey velocity;

wherein, the reverse convey section is configured to receive said each transfer sheet having an obverse surface on which image printing is performed by said image printing section, convey said each transfer sheet upon changing the first convey velocity to a third convey velocity by acceleration at a timing set on the basis of the first time measured by said first timepiece section and required for image printing on the observe surface of said each transfer sheet, and reverse the obverse surface and reverse surface of said each transfer sheet while reversing a convey direction of said each transfer sheet;

a re-feed section configured to receive said each transfer sheet reversed by said reverse convey section, convey said each transfer sheet upon changing the third convey velocity to a fourth convey velocity by deceleration at a timing set on the basis of the second time measured by said second timepiece section and required for conveyance including the reversing of said each transfer sheet, and feed said each transfer sheet again to said image printing section; and a delivery convey section configured to receive said each transfer sheet having a reverse surface on which image printing is performed by said image printing section, and convey and deliver said each transfer sheet upon changing the first convey velocity to the second convey velocity, wherein the transfer sheets are delivered while intervals between the transfer sheets are adjusted by said reverse convey section, said re-feed section, and said delivery convey section.

18. An apparatus according to claim 17, further comprising a first detection portion which is provided near a position where the transferring is performed, and is configured to detect said each transfer sheet, a second detection portion which is provided near a position where the fixing is performed, and is configured to detect said each transfer sheet, and a third detection portion which is provided near a position where the reversing is performed, and is configured to detect said each transfer sheet, wherein said first measuring portion measures a time required for image printing on the observe surface and the reverse surface on the basis of detection results obtained by said first detection portion and said second detection portion, and said second timepiece section measures a time required for conveyance including the reversing on the basis of at least a detection result obtained by said third detection portion.

19. An apparatus according to claim 17, wherein the fourth convey velocity is equal to the first convey velocity.

20. An apparatus according to claim 17, further comprising a post-processing apparatus configured to receive delivered said each transfer sheet and perform post-processing, and a notifying unit configured to notify said post-processing apparatus of a state of said each transfer sheet when the first convey velocity is changed to the second convey velocity.

* * * * *